United States Patent [19]

Kelly

[11] 4,255,064

[45] Mar. 10, 1981

[54] PRINTING DEVICE WITH PAPER EDGE SENSING

[75] Inventor: Hugh-Peter G. Kelly, Leigh-on-Sea, England

[73] Assignee: A.E.S. Wordplex Limited, London, England

[21] Appl. No.: 962,022

[22] Filed: Nov. 20, 1978

[30] Foreign Application Priority Data

Nov. 22, 1977 [GB] United Kingdom ..... 48472/77
Apr. 25, 1978 [GB] United Kingdom ..... 16244/78

[51] Int. Cl.[3] ..... B41J 25/00; B41J 25/30

[52] U.S. Cl. ..... 400/708; 400/282; 400/583.3; 271/261

[58] Field of Search ..... 400/612, 282, 583.3, 400/579, 671, 708, 708.1; 271/261, 227; 226/20; 242/57.1

[56] References Cited

U.S. PATENT DOCUMENTS

| | | | |
|---|---|---|---|
| 2,082,634 | 6/1937 | Johnstone | 226/20 X |
| 2,088,473 | 7/1937 | Gulliksen | 226/20 X |
| 2,181,992 | 12/1939 | Ghertman | 400/583.3 X |
| 2,860,759 | 11/1958 | Clark | 400/282 |
| 2,953,231 | 9/1960 | Dersch | 400/282 |
| 3,020,996 | 2/1962 | D'Onofrio | 400/282 X |
| 3,556,425 | 11/1971 | Keesling et al. | 242/57.1 |
| 3,658,163 | 4/1972 | Sniderman | 400/583.3 X |
| 4,089,517 | 3/1978 | Marass | 271/227 X |

FOREIGN PATENT DOCUMENTS

| | | | |
|---|---|---|---|
| 560681 | 7/1958 | Canada | 226/20 |
| 734106 | 5/1966 | Canada | 400/583.3 |
| 2705282 | 8/1978 | Fed. Rep. of Germany | 400/705 |
| 1090636 | 10/1954 | France | 400/708 |
| 905079 | 9/1962 | United Kingdom | 400/282 |

OTHER PUBLICATIONS

Smith, "Paper Edge Sensing," IBM Technical Disclosure Bulletin, vol. 20, No. 3, Aug. 1977, p. 904.

Crawford et al., "Tape-Presence Sensor," IBM Technical Disclosure Bulletin, vol. 20, No. 3, Aug. 1977, pp. 1198-1199.

Wipke, "Right Hand Margin Set and Print Inhibit," IBM Technical Disclosure Bulletin, vol. 20, No. 10, Mar. 1978, pp. 3996-3997.

*Primary Examiner*—Clifford D. Crowder
*Attorney, Agent, or Firm*—Lewis H. Eslinger

[57] ABSTRACT

In order to ensure correct registration of printing, a printing device is provided with a transducer arrangement which scans the printing platen to detect one of the edges of the stationary or, in the case of continuous feed stationery, pre-printed markings on the stationery. The scanning may take place in the vertical and/or horizontal directions according to the direction in which precise registration is desired. The transducer arrangement is provided with an associated light source and to avoid errors arising, e.g. from variations in ambient lighting level, the transducer arrangement comprises two sensors which are spaced apart in the direction of scanning and an associated circuit forms a difference signal from the outputs of the sensors, which is discriminated with respect to a predetermined threshold level to produce a signal representative of the edge or marking. In a second embodiment the sensors are spaced apart along a line which is inclined relative to the vertical and horizontal directions so that both vertical and horizontal registration may be achieved using only two sensors provided, of course, that vertical and horizontal movements of the stationery do not occur simultaneously.

14 Claims, 7 Drawing Figures

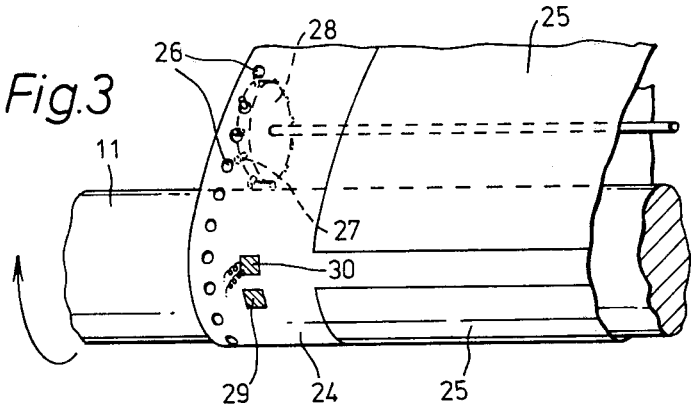
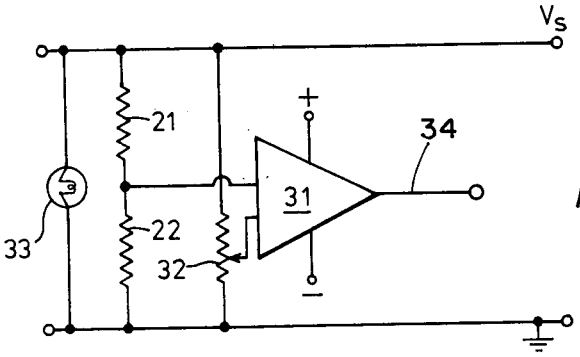
Fig.4
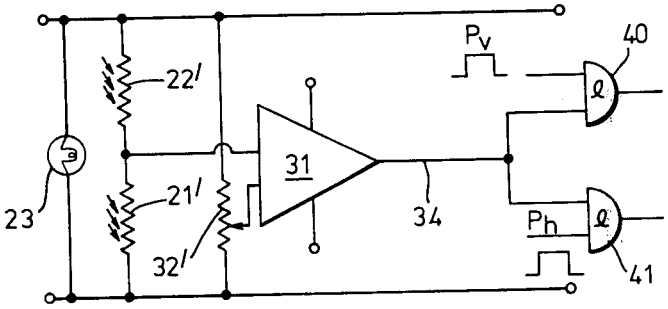
Fig.7

PRINTING DEVICE WITH PAPER EDGE SENSING

DESCRIPTION

This invention relates to a stationery detecting device for printers.

A large and rapidly expanding use of computers and computing techniques is in the field of the preparation and printing of all forms of documents. A specific use is that known as Word Processing. This term is applied to equipment and software programmes run within such equipment to increase the productivity of typists. Such equipment may, for example, comprise: an electronic keyboard (to take the place of the customary typewriter keyboard), a visual display unit or VDU (for displaying the text typed), a central processor unit (for running the software programmes necessary for the manipulation and retrieval of text to be displayed), a disc storage unit (for storing standard texts and documents to be printed) and a high quality electromechanical printing device for the actual printing of the typed text.

Characters corresponding to those typed on the electronic keyboard are displayed on the V.D.U. If the typist makes a mistake, special control keys on the keyboard enable individual characters, words, sentences, paragraphs, or—even—a whole page of text, to be erased instantly. The typist is also able to have access from the disc storage unit of the system 'standard paragraphs' which can instantly be interposed within the original text. It is also possible to widen or contract the left hand and/or right hand margins of a completed text for aesthetic reasons, or for accommodating the text within stationery of a particular width. The software programmes which are run within the central processor unit, automatically reorganise all the words, spaces and punctuation marks, so ensuring that the text is presented in a logical fashion as wide or as narrow as is desired. As soon as a letter or text has been completed (the typed text being held temporarily within a memory associated with the typist's V.D.U. or, alternatively, on the disc storage unit) it is possible to activate an output programme which will automatically cause selected portions of the typed text to be printed on the printing device.

The authors of letters typed on such equipment may occasionally require the use of pre-printed stationery, for instance forms or letters already bearing such captions as 'Extension No.,', 'Your ref: Our ref:' and the like. Displacement parameters within the output programme controlling the printer will be pre-set and adjusted beforehand to ensure that the correct text appears in exactly the correct spaces. It is essential to position the stationery on which the text is to be printed such that its displacements in the horizontal and vertical senses register with the pre-set displacement parameters, otherwise for example the pre-printed captions could be overprinted. In typing pools where speed is of the essence, such careful positioning of stationery is time consuming and tedious.

According to the present invention, there is provided a printing device comprising a printing mechanism for printing on stationery, a transducer arrangement arranged to scan stationery within the printing device to sense the position of the stationery and control circuitry responsive to the output of the transducer arrangement for providing a signal to ensure registration of the stationery and print applied thereto by the printing mechanism.

The following description will be given with reference to the application of the present printing device to a Word Processor although it will be appreciated that the use of the printing device is in no way limited to word processors.

The transducer arrangement can be used for establishing the horizontal and/or vertical displacements of the stationery and thus ensure the corresponding activation of the printing mechanism according to one or both of these displacements. In general, however, the typist or operator responsible for mounting the stationery is able to position it accurately with relative ease in the vertical sense. [This is on account of the fact that platens of printers used in Word Processing systems usually resemble in operation those of ordinary typewriters, having a handle for feeding the stationery into the printer in discrete steps, for example, half or one line at a time]. It will also be appreciated that use of the present device enables a typist to insert paper anywhere across the possible range of movement of the printing mechanism as the position of the stationery is automatically established obviating the necessity to position it accurately initially, according to pre-set parameters.

In one embodiment of the invention, the transducer arrangement can be mounted on a carriage movable horizontally across the printer and comprises a transducer sensitive to electromagnetic radiation and positioned to detect changes in reflected radiation effected by the presence of the stationery. The change in characteristics of the transducer corresponding with the detection of stationery is interpreted by control means which, in turn, ensure the registration of the printing mechanism with the stationery.

A disadvantage of using a word processing system is the ease with which a typist can start a printing programme without mounting stationery within the printer of the system. Damage to both the printing mechanism and the platen of the printer can occur if this is not done. A feature of the above described embodiment of the invention provides for the transducer to be caused to move from a given datum point each time it searches to detect stationery, and if the time taken by the movement of the apparatus from the datum point equals or exceeds a predetermined reference value, activation of the printing mechanism is prevented. The reference value can be set to a period during which stationery would normally be detected (stationery might as mentioned earlier be positioned anywhere across the width of the printer). Thus, if the typist neglects to mount stationery within the printer, which will not then be detected, activation of the printing mechanism, with consequent damage, will be prevented.

For those applications of word processing systems which require continuous or repetitive printing, but on separate pieces of paper, a system often used is one in which, for example, the actual sheets of paper on which text is to be printed are affixed lightly to a continuous backing sheet, known as continuous feed stationery. The continuous feed stationery passes through the printer and is perforated along each edge by regularly spaced holes receiving spokes of drive wheels controlled by the printer. Rotation of the drive wheels causes movement through the printer of the continuous feed stationery—and thus the actual sheets to be printed. To ensure that each sheet to be printed is precisely presented—in the vertical sense—to the printing mechanism, the sheets are mounted very accurately at regular intervals on the continuous feed stationery, and the rotation of the drive wheels of the printer is controlled very carefully. However, minute variations in both of these parameters can accumulate each time a new sheet passes through the printer, until at some point, the printing mechanism is no longer activated in register with the stationery. Where as mentioned earlier, the stationery is pre-printed with captions, the printing mechanism, when this happens, may print text out of line with such captions.

The motion of continuous feed stationery through e.g. a line printer can be controlled by a form of the transducer arrangement and control circuitry in which the transducer arrangement is positioned to sense pre-imposed irregularities along the length of the stationery, the action of stationery drive wheels of the printing device and the printing mechanism being controlled as appropriate depending on whether or not one of the irregularities has been detected. The pre-imposed irregularities can, for example, be each separated by the distance between each of the actual sheets to be printed. Thus, once a sheet has been located by means of a sensed irregularity, the 'feed action' of the drive wheels of the printer can be halted, and the printing mechanism can be activated. Using this method to control the motion of continuous feed stationery through the printer obviates the need for accurate location thereon of the paper to be printed, and also precise control of the advancement motion of the paper drive wheels of the printer. Accumulative error is avoided.

As well as the use of this method of vertical registration (and also, of course, of the horizontal registration) in printing devices of word processing systems, similar use can be made in those printers commonly known as line printers. These are used widely in general computer systems, especially for such applications as printing, on pre-printed stationery, bills, statements and the like. Such line printers often use electro-mechanical devices, known as vertical formatting units, to control the movement of paper in between printing operations. These units are comparatively complicated and introduce an extra element of control for determining the movement of stationery within the line printer. A 'top-of-form' action must be carried out by an operator before carefully mounting the stationery in a pre-defined position. By using, instead, stationery along which pre-imposed irregularities have been printed to indicate, say, a new sheet or form, a transducer arrangement can be provided to directly control the 'paper-throw' mechanism of the printer, in similar fashion to the control of the feed action of continuous feed stationery just described. The present device can replace, or work in conjunction with, the vertical formatting unit of the line printer.

The transducer arrangement may, as mentioned earlier, include a transducer sensitive to electromagnetic radiation. When used to sense, for example the horizontal position of stationery, a preferred type of such a transducer is a photoelectric cell. When, for example, this is moved across the platen of the printing device, sensing of stationery occurs when the general light received by the cell and reflected by the surface of the platen (which is usually of a dark matt nature) increases as the cell approaches the more reflective stationery. The control circuitry is used to interpret the change in value of characteristics of the cell corresponding to these two conditions. It will be appreciated that in this arrangement, ambient light reflected by the platen may falsely indicate in very bright lighting conditions the presence of stationery or, alternatively, in dull conditions light reflected by stationery into the cell may be inadequate for detection of the stationery.

In one form the transducer arrangement comprises an array of two or more spaced apart sensors interconnected in such manner that when a current is passed therethrough and one part of the array receives radiation of different intensity to another, a change occurs in the potential with respect to either end of the array of at least one of the interconnections. Suitably two photo-resistors connected in series and placed side by side may be used. A small light source may advantageously be positioned adjacent to the resistors for increasing the level of ambient light. A potential is applied to the free ends of the resistors. When one resistor is positioned over stationery mounted in the printer and the other is positioned over the platen, the potential of the interconnection changes. This change can be appropriately interpreted by the control circuitry. Within the tolerance imposed by slight dissimilarities in characteristics of the two resistors, this arrangement is unaffected by variations in the general level of ambient light, as such variations will affect the resistance of both photo-resistors equally. An advantage of this arrangement is that on being moved across the platen of the printer, both the left-hand and right-hand edges of stationery mounted therein can be identified, as the potential of the interconnection between the two resistors will rise and then fall from a quiescent value with such motion. Such detection of both edges can be used to convey to the printing mechanism of the printing device the width of the stationery. This information could also be made available to the output programme controlling the printing which could then automatically re-adapt the text to suit the width of the stationery. Similarly, the top and bottom of stationery mounted within the printer can be identified by a transducer arrangement adapted for ensuring vertical registration, as in the case of the continuous feed stationery. The length of a sheet of stationery could thus be made available to the printing programme to ensure that surplus lines of text would be printed on the following sheet. A further variation is the use of the signals from the control circuitry to only permit printing on white areas of a form where other areas are relatively darker.

It will be appreciated that the output signals of transducers of the type described above normally require the use of electronic amplification apparatus to enable the change of characteristics thereof to control the printing mechanism of the printing device.

The invention will now be described in more detail, by way of example, with reference to the accompanying drawings in which:

FIG. 3 is an illustration of part of a further embodiment of this invention;

FIG. 4 is a circuit diagram of the stationery detecting apparatus of FIG. 2;

FIG. 7 shows circuitry incorporated in the device of FIG. 5.

Figure 1:
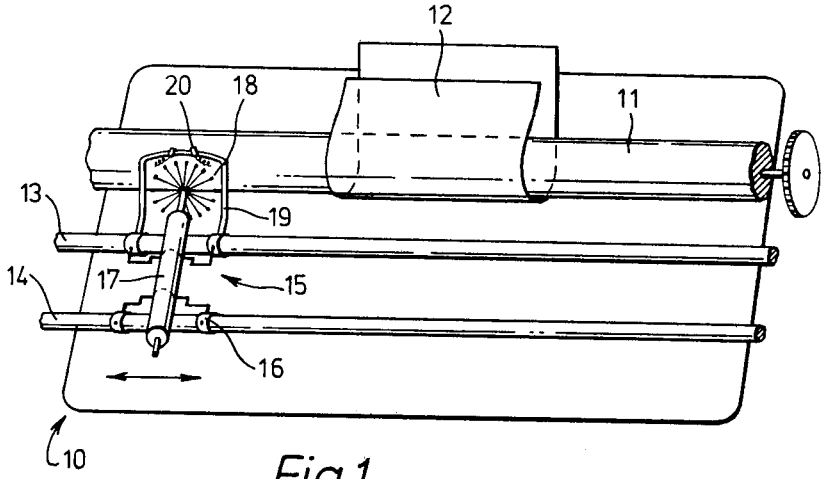
FIG. 1 is a diagram of part of one embodiment of printing device according to the present invention, for use in a word processing system.

The embodiment of printing device shown in part in FIG. 1 is intended to be incorporated in a word processor also incorporating an appropriately programmed central processing unit, mass storage unit for text to be printed, keyboard, display unit and the various items of interface circuitry required to interface the processing unit to the other components of the processor. The printing device is generally designated 10 and includes a platen 11 embraced circumferentially along part of its length by stationery 12. Two guide bars 13 and 14 are mounted on the printer and are positioned parallel to and in front of the platen 11. The guide bars are used to enable a trolley 15 to slide in a horizontal sense from left to right and vice-versa, as indicated by the arrow. The trolley is held in position on the guide bars 13 and 14 by four collars, one of which is shown at 16. Affixed to the collars by brackets is a small stepping motor, 17. Protruding from the end of the motor nearest the platen is a spindle on which is mounted a printing wheel 18. (This wheel is known as a daisy wheel and comprises a multiplicity of flexible radial arms ending in a printing head bearing a character. The principal of operation is that the wheel rapidly rotates and at a predetermined point, a hammer (not shown) strikes the printing head and causes a character to be imprinted—through an inked ribbon (also not shown)—onto the stationery. The trolley then moves along the guide bars and a further character is printed, and so on). A mounting bracket 19 is affixed to the two collars riding the guide bar 13 and acts as a base for stationery detecting apparatus indicated generally at 20 and incorporating a transducer arrangement for detecting the position of the stationery.

Figure 2:
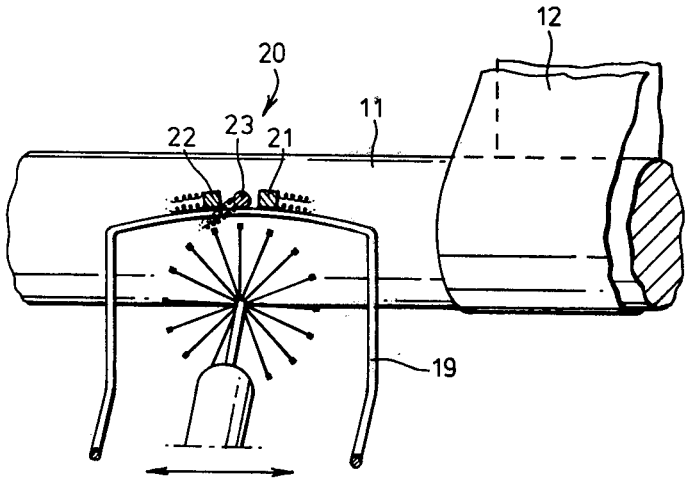
FIG. 2 is an illustration showing enlarged and in more detail, part of the printing mechanism and transducer arrangement of the embodiment of FIG. 1.

Referring to FIG. 2, the stationery detecting apparatus 20 comprises two photo-resistors 21 and 22 located side by side on the mounting bracket 19. Positioned between the two resistors is a tungsten filament bulb 23. The photo-resistors and bulb face the surface of the platen. Sufficient space between the combination and the platen is allowed to permit reflected light to enter the photo-resistors. The photo-resistors are connected in series and a potential is applied to their free ends. (This potential may also conveniently be used to supply the bulb 23).

The mode of operation of the apparatus is as follows:

As soon as the whole assembly is moved on the trolley 15 from left to right, a change in value of the reflected light occurs as soon as the detecting apparatus approaches the stationery. (The platen of such printers is usually of a dark matt nature as opposed to the reflective nature of stationery). The photo-resistor 21 which reaches the stationery 12 first, drops in resistance, and therefore causes the potential of the interconnection between the resistors to change. This change is interpreted by control means (to be hereinafter described in more detail) and activation of the printing mechanism is permitted.

Thus it will be appreciated that stationery bearing pre-printed captions can be inserted into the printer without careful positioning in the horizontal sense, and the printing mechanism, as directed by the output programme, will only print in the desired locations. The effects of ambient light and variations in temperature on the two photo-resistors alter the characteristics of each equally. Thus, in this arrangement, the quiescent value of the potential of the interconnection remains unaltered during such variations and is only changed when one resistor receives a different amount of light to the other.

As mentioned before, the locations at which the characteristics of the transducer change as it traverses the left and right hand edges of the stationery can be conveyed to the output programme of a word processing system in which this apparatus is used to enable it automatically to re-adjust text, before printing, to suit the width of the stationary.

Referring to FIG. 3, stationery of the type known as continuous feed stationery is indicated generally at 24. Sheets of paper on which text is to be printed and which are lightly affixed to the stationery 24 are shown at 25. Indicated along the left hand edge of the stationery 24 are regularly spaced holes 26 for receiving spokes 27 of a drive wheel 28. (A similar scheme, not shown, is present on the right hand side of the printing device). When the drive wheel 28 is rotated, the continuous feed stationery is fed around the platen. Regularly spaced marks, corresponding precisely to each of the sheets 25, are located along the left hand edge of the stationery, one being shown at 29. Positioned to sense such marks is detecting apparatus indicated generally at 30. The operation of this arrangement is as follows.

Every time the printing device finishes printing on one of the sheets 25, the drive wheels 28 are rotated to advance the stationery 24 until a mark is sensed by the detecting apparatus 30. The printing mechanism is then permitted, by control means responsive to the detecting apparatus, to be activated. Thus each sheet 25 is precisely presented in the vertical sense, so ensuring that text is printed precisely in line with, say, pre-printed captions. It will be appreciated that the detecting apparatus may take the form of that indicated in FIG. 2 as a contrast in reflected light is occasioned by the presence of the marks. Alternatively, holes in the stationery 24 may be cut in place of the marks, and through these, the dark matt surface of the platen may be sensed.

A more detailed explanation of the stationery detecting apparatus shown in FIG. 2 will now follow with reference to FIG. 4. The two photo-resistors 21 and 22 of FIG. 2 are indicated as two resistors connected to one input of a differential comparative operational amplifier 31. The other input of the amplifier is connected to a potential divider 32 to provide a reference voltage. The bulb used to augment the general level of light impinging on the platen and stationery is shown at 33. The amplifier used is of the type which gives a change in output voltage at an output line 34 when the potential of one input exceeds the other, with reference to a given datum potential. The action of the circuit is as follows:

The potential of the reference voltage is first pre-set to be just above the quiescent value of the junction of the two resistors. As soon as the resistance of the photo-resistor 21 drops on sensing stationery, the reference voltage is exceeded, and the output of the amplifier 31 changes. (Note, however, that once both resistors are situated over stationery, the quiescent value of the junction potential is restored as the resistances of each will be equal).

The actual time of change of the output of the amplifier can be adjusted by varying the discrepancy between the quiescent input voltage and the reference voltage. Thus the apparatus can be adjusted to detect the left hand edge of the stationery exactly.

It will be appreciated that this circuit can be employed to detect the right hand edge of the stationery.

Figure 5:
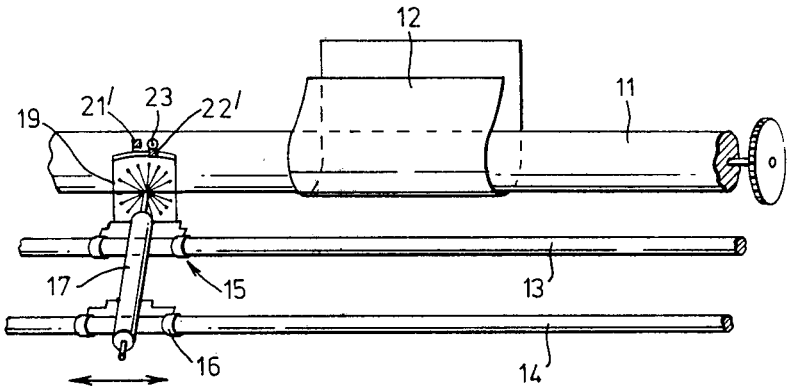
FIG. 5 is an illustration of part of a further embodiment of this invention.
Figure 6:
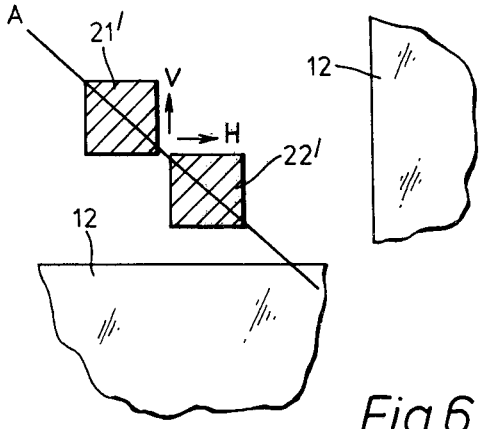
FIG. 6 shows the disposition of the sensors of the device of FIG. 5.

The reference potential is instead set initially below the quiescent value, the former value being crossed as the resistance of the photo-resistor 21 rises as it reaches the exposed platen. Thus two operational amplifiers can be used together to give outputs changing respectively as each edge of the stationery is traversed by the stationery detecting apparatus.

Where a number of discrete items of stationery are to be printed on in succession ensuring both horizontal and vertical registration of sheets in the printer is a time consuming process. Clearly, the embodiments of the present invention can be so adapted as to ensure vertical and horizontal registration of a sheet. This could, of course, be done by using two separate transducer arrangements, one to detect a horizontal edge or marking on a sheet and another to detect a vertical edge or marking. The embodiment shown in FIGS. 5 to 7 uses a single transducer arrangement, comprising a pair of transducers 21' and 22' to indicate both horizontal and vertical edges or markings. The principle on which the operation of the embodiment is based is probably most readily appreciated from FIG. 6 where the vertical and horizontal directions, V and H respectively, correspond to rotation of the cylindrical platen and movement of the trolley 15 lengthwise of the platen, respectively. As shown, the transducers 21' and 22' are spaced apart along a line indicated as A which extends in a direction which is inclined relative to both the V and H directions. It will be appreciated that when either the trolley is shifted or the cylindrical platen rotated, so that a stationery edge or marking approaches the transducer arrangement, the output of one of the transducers (22' for upward movement of the paper or rightward movement of the trolley) will change its output before the other. Provided that vertical and horizontal shifts do not take place at the same time, horizontal and vertical edges or markings can be discriminated.

The circuitry associated with the sensors 21' and 22' is shown in FIG. 7. With the potentiometer 32' set so that the reference potential applied to the comparator 31 is somewhat above the potential at the junction of the photo sensors 22' and 21', then when the edge of an item of stationery comes into the field of view of the sensor 22' by way of the vertical or horizontal leading edge of the item stationery approaching by relative movement the transducer arrangement, the output of the comparator 31 will change. Two pulse signals PH and PV can be derived from the printer control circuitry which are high for periods when the trolley 15 is moving lengthwise of the platen and the platen is rotating respectively. By arranging the control circuitry to ensure that these two operations do not occur simultaneously (so that the high parts of these two pulses do not overlap when detection takes place), the outputs from two AND gates 40 and 41 to which these signals are respectively applied can be appropriately interpreted to indicate detection of the left hand and top edge of the item of stationery, respectively. By applying the outputs from the junction of the two photo-sensors to a further comparator whose reference potential is set slightly below the quiescent potential at this junction, the right hand and bottom edge of the item stationery can also be detected. In another version of the apparatus, the common junction of the photo-sensors can be applied to inputs of four separate comparators each of which has an appropriate reference potential applied thereto so that the comparator outputs correspond individually to the left hand, right hand, top and bottom edges of the item.

As well as detecting the contrast between the relatively dark platen and the lighter surface of the item of stationery, the arrangement can also be used to establish registration with respect to areas of different contrast (e.g. dark marking) on stationery, be it continuous feed stationery or individual items.

Where two corresponding edges, that is the right and left or top and bottom edges, of an item of stationery are detected, by measuring the time between the two edges being detected or by counting the number of stepping pulses applied to the trolley drive or the platen drive as appropriate the width and length of an item of stationery can be measured.

Commercially available comparators have high sensitivity and this combined with appropriate adjustment of the reference potential (with which the sensor(s) output is compared) makes it possible to obtain a signal to ensure precise registration of print.

Numerous modifications of the present printing device will be apparent to those skilled in the art. For example, the control circuitry can be arranged to turn on the bulb 23 only when the position of the stationery is being detected; illumination of the bulb can then be controlled by a suitable signal originating in the processing unit.

Furthermore the control circuitry can be arranged to produce its output signal indicating detection of the stationery in such a manner that there is delay of appropriate duration between the stationery being detected and the movement of the printing mechanism and transducer arrangement being stopped so that they stop a predetermined position beyond the edge or the marking being sought. In the case of detecting the edge of the stationery this can be used, for example to stop the printing mechanism one character width in from the edge so that printing can then start immediately. The delay may be generated by means of a monostable multi-vibrator.

I claim:

1. A printing device comprising a printing mechanism for printing on stationery and means for ensuring registration of the stationery and print applied thereto by the printing mechanism without the necessity of providing any indicating markings on said stationery, said means comprising a transducer arrangement arranged to scan stationery within the printing device and a control circuit for controlling operation of the printing mechanism and responsive to the output of the transducer arrangement for detecting and identifying the leading edge of an item of stationery being scanned and thereby providing a signal indicating the detected leading edge of the item, the control circuit being arranged so that before the start of printing on the item of stationery, the transducer arrangement scans for the leading edge of the item so as to produce said signal to enable text to be registered with the item and whereby printing of the text occurs with reference to the detected leading edge.

2. A printing device according to claim 1 wherein the transducer arrangement and control circuitry are operative to detect differences in reflectivity.

3. A printing device according to claim 1 further comprising a common support on which the transducer arrangement and printing mechanism are mounted for movement together relative to stationery mounted within the device.

4. A printing device according to claim 1 further comprising a cylindrical platen on which, in use, the stationery is mounted, at least the printing mechanism being movable relative to the platen longitudinally thereof to print across the width of the stationery and the platen being rotatable to effect a line feed of the stationery.

5. A printing device according to claim 4 wherein the transducer arrangement is arranged to scan longitudinally of the platen to detect a leading edge of the stationery.

6. A printing device according to claim 1 wherein the transducer arrangement is arranged to detect the vertical position of the stationery so as to enable vertical registration to be achieved.

7. A printing device according to claim 1 wherein the transducer arrangement comprises a sensor for sensing electro-magnetic radiation reflected from the stationery.

8. A printing device according to claim 7 wherein two such sensors are provided, the sensors being spaced apart and the control circuitry is operative to produce said signal by detecting the difference in outputs of the sensors.

9. A printing device according to claim 8 wherein the sensors are spaced from one another in a direction which is inclined relative to both the longitudinal and lateral directions of the stationery and the arrangement is such that during scanning relative movement of the transducer arrangement and stationery does not occur in both said directions simultaneously.

10. A printing device according to claim 1, and including an electro-magnetic radiation source disposed to cause said radiation to impinge on the stationery.

11. A printing device according to claim 1 wherein the area of the stationery scanned by the transducer arrangement is coincident with, or directly adjacent to, the printing zone of the printing mechanism.

12. A printing device comprising: a printing mechanism for printing on items of stationery and adapted to be movable relative to the items of stationery in the lateral and longitudinal directions of the items of stationery; and means for ensuring registration of the items and print applied thereto by the printer without the necessity of providing any indicating markings on said stationery, said means comprising a transducer arrangement for scanning the items of stationery and comprising a pair of sensors spaced apart along a line which is inclined relative to said lateral and longitudinal directions and a control circuit for controlling operation of the printing mechanism and responsive to the sensors for detecting and identifying the leading edge of an item of stationery being scanned by the transducer arrangement and thereby to produce an output signal to enable registration of the item of stationery and text printed thereon by the printing mechanism, the control circuit being arranged so that before the start of printing on the item of stationery, the transducer arrangement scans for the leading edge of the item so as to produce said signal to enable the text to be registered with the item and whereby printing of the text occurs with reference to the detected leading edge.

13. The printing device according to claim 12; in which said pair of sensors scans for the leading edges of the item of stationery in the lateral and longitudinal directions of the item of stationery.

14. A printing device comprising:

a printing mechanism for printing on stationery; and means for ensuring registration of the stationery and print applied thereto by the printing mechanism without the necessity of providing any indicating markings on said stationery, said means comprising a transducer arrangement arranged to scan stationery within the printing device, said transducer arrangement including a pair of sensors for detecting variations in light intensity from a reflection surface, said transducer arrangement producing a detected signal corresponding to the difference between the light intensities detected by each sensor, and a control circuit for controlling operation of the printing mechanism and responsive to said detected signal for detecting and identifying the leading edge of an item of stationery being scanned and thereby providing a signal indicating the detected leading edge of the item for positioning text to be printed, said control circuit including comparator means for comparing said detected signal with a reference signal to produce said indicating signal, the control circuit being arranged so that before the start of printing on the item of stationery, the transducer arrangement scans for the leading edge of the item so as to produce said signal to enable the text to be registered with the item and whereby printing of the text occurs with reference to the detected leading edge.

* * * * *